US011306988B1

(12) United States Patent
Osborn

(10) Patent No.: US 11,306,988 B1
(45) Date of Patent: Apr. 19, 2022

(54) HAMMER EXTENSION FOR A MUZZLE LOADING FIREARM

(71) Applicant: Richard Douglas Osborn, Harborcreek, PA (US)

(72) Inventor: Richard Douglas Osborn, Harborcreek, PA (US)

(73) Assignee: Richard D. Osborn, Harborcreek, PA (US)

( * ) Notice: Subject to any disclaimer, the term of this patent is extended or adjusted under 35 U.S.C. 154(b) by 0 days.

(21) Appl. No.: 17/180,814

(22) Filed: Feb. 21, 2021

(51) Int. Cl.
*F41A 19/14* (2006.01)
*F41C 9/08* (2006.01)

(52) U.S. Cl.
CPC ..... *F41A 19/14* (2013.01); *F41C 9/08* (2013.01)

(58) Field of Classification Search
CPC ..... F41A 19/14; F41C 9/08
See application file for complete search history.

(56) References Cited

U.S. PATENT DOCUMENTS 4,208 A * 9/1845 Mayard ..... F41C 9/085 42/69.01
5,408,776 A * 4/1995 Mahn ..... F41C 9/08 42/51
5,704,149 A * 1/1998 Bethshears ..... F41C 9/08 42/1.04

* cited by examiner

*Primary Examiner* — Joshua T Semick

(57) ABSTRACT

A hammer extension design for use with various firearms, including specifically muzzle-loading firearms, that makes operating the hammer easier, faster, and safer. The present invention discloses a muzzle-loading firearm which includes a stock, a barrel fastened to said stock, a pivot mounted to said stock, a trigger and hammer mechanism comprising of a hammer and a lever arm both secured to said pivot.

6 Claims, 4 Drawing Sheets

HAMMER EXTENSION FOR A MUZZLE LOADING FIREARM

BACKGROUND OF THE INVENTION

1. Field of the Discovery

The disclosed embodiments relate to an accessory that will improve the use, the safety, and the ergonomics of firearms such as a muzzle loading firearm, also called a muzzle loader.

2. Background Information

The present invention relates to muzzle-loading firearms and more particularly the hammer mechanism used in connection with lock action muzzle-loading firearms, wherein a hammer is pulled backward to the engaged or cocked position, where it is held in place under the tension of a spring. When a trigger is pulled, it releases the hammer which strikes another component to create a spark that will ignite the charge inside the barrel of the firearm. Traditional muzzle-loading type guns suffer from the disadvantage of having an external hammer mechanism that is not aligned with the center of the barrel, as in conventional firearms. Instead, the hammer is attached to the side of the gun, and somewhat forward. This makes operation of the hammer for firing the gun cumbersome, compared to modern firearms. Despite the cumbersome operation, many traditional muzzle-loader users prefer to maintain all of the original parts of the firearm.

Along with the awkward position of the hammer, the force needed to cock the hammer back is substantial. The design of the hammer itself is also a disadvantage because of its location on the firearm and lack of ergonomic comfort. It is because of the awkward shape and position of the hammer and the extreme tension of the hammer spring that the safety of the user and those around the user is compromised. As such, there is a perceived need for a solution to improve the ability to safely and comfortably engage and disengage the firearm.

SUMMARY

The present invention addresses the problems encountered in safely cocking, disengaging, and firing traditional muzzle-loader type firearms. And because the invention is an accessory that is added to the firearm, and not a replacement part, the authenticity of the firearm is not compromised. The design of the present invention provides the advantage of making the existing hammer easier to engage or disengage, quicker to engage or disengage, and safer to engage or disengage. The physical strain on the thumb to operate the hammer is minimized due to the leverage provided by the extension arm.

Another object of the present invention provides a more ergonomic property to the existing hammer while sighting a target. When a shooting opportunity occurs, a hunter would have the advantage of a quicker response, and a more likely chance to harvest game. The conventional hammer mechanism is difficult to engage the while sighting a target. The hammer extension allows the hunter to quickly sight his target while allowing easy cocking of the hammer mechanism.

BRIEF DESCRIPTION OF THE DRAWINGS

FIG. 4 also shows the flintlock frizzen in the forward position, to provide a view of the touch hole.

DETAILED DESCRIPTION OF THE INVENTION

Figure 1:
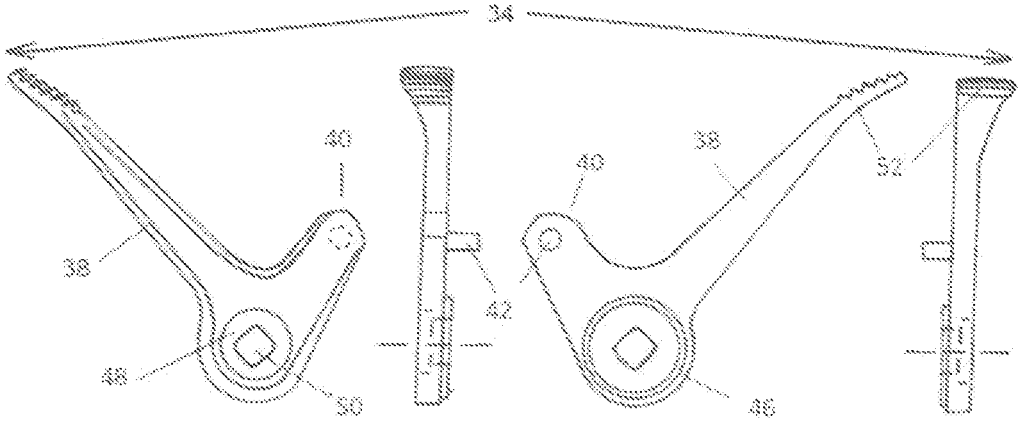
FIG. 1 shows exactly what the invention looks like from four (4) different views

The invention is one piece. It is shown in the drawings as intended for a right handed firearm, but could also be manufactured for a left handed firearm. FIG. 1 shows four views of the invention, the right side, front, left side and rear views respectively. The hammer extension 34 itself is an L shape. The shorter part of the L is the engagement head 40, where the engaging pin 42 is located. The engaging pin 42 is a small rod on the left side of the engagement head 40, and the point of contact where the invention engages the hammer of the firearm. The longer part of the L is the extension arm 38, which provides both the reduced distance for the thumb to cock the hammer of the firearm, and the reduced force needed to operate the hammer of the firearm. At the end of the extension arm 38 is a knurled surface 52 that provides a gripping surface. Where the engagement head 40 and the extension arm 38 meet at a 90 degree angle is a square hole 50. This square hole 50 is where the invention is mounted over the existing hammer of the firearm to the action pivot of the firearm. The area around the square hole 50 is different on each side of the invention. The area around the square hole 50 on the right side of the invention is a round recessed hole 48 that allows the head of the mounting screw to be recessed. The area around the square hole 50 on the left side of the invention is a raised surface 46 to provide a small space between the invention and the hammer of the firearm.

In order to provide an understanding of the invention and its versatility. I will provide some explanation of what differentiates the traditional muzzle loader from others. Traditional muzzle loaders use a lock action and are a more primitive type of muzzle loading firearm. The muzzle loading firearm, whether a traditional model or a more modern type, are loaded from the muzzle end of the barrel, where the bullet exits. To load or reload the gun, one must pour a measured amount of black powder into the barrel, and then force a lead ball or a bullet down the barrel into the firing chamber of the barrel using a ram rod that is stored in a channel under the barrel of the firearm. The bullet is then tapped tight against the powder with the ram rod. The black powder in a muzzle loading firearm is referral to as the charge, and is what propels the projectile out of the muzzle end of the barrel. The firing chamber is at the end of the barrel opposite the muzzle, and contains the charge. This method of loading the firearm is what defines the muzzle loader. The traditional muzzle loading firearms can be found in rifle and pistol form. My invention can be used on both rifles and pistols of any traditional lock type muzzle loaders.

The means of igniting the charge is what differentiates the traditional muzzle loaders. There are several methods in which lock type firearms can ignite the charge, from a match striking a surface to a surface striking a primer cap. Whatever the method of ignition the lock action employs, the lock action consists of a striking hammer mounted to a pivot that is spring loaded and, when manually pulled rearward or "cocked", is held in place by an internal mechanism. A trigger releases the cocked hammer, thus providing the force needed for whatever means of ignition to occur. However, when the user wishes to disengage the firearm without firing it, he must control the tension on the hammer while pulling the trigger, so as not to allow the hammer to create spark and unintentionally lire the weapon.

The most commonly used of the traditional muzzle loading firearms are the percussion caplock and the flintlock. It is because these two types of traditional muzzle loaders are most common that I have used them in my drawings to describe how my invention improves the ergonomics and the safe use of the traditional form of muzzle loading firearm. My drawings also provide an understanding of the versatility of the invention in its capability of being used on any type of lock action firearm, and not being limited to one particular type.

A caplock firearm is considered ready to fire only when the charge has been loaded into the firing chamber of the barrel, and a cap has been placed on the nipple. A flintlock firearm is considered ready to fire only when the charge has been loaded into the firing chamber of the barrel, and a small amount of black powder is placed in a flash pan. The sparks from the flint alone will not ignite the charge inside the firing chamber of the barrel. Therefore a small amount of black powder must be placed in the flash pan located at the chamber end of the barrel in order to produce a sufficient source of ignition. This makes the flintlock a less reliable means of ignition than the caplock. However, certain states in the U.S. may only allow certain types of muzzle loading firearms to be used to harvest game. Below is further description of how the caplock firearm and the flintlock firearm differ, and how the invention can be applied to each.

Figure 2:
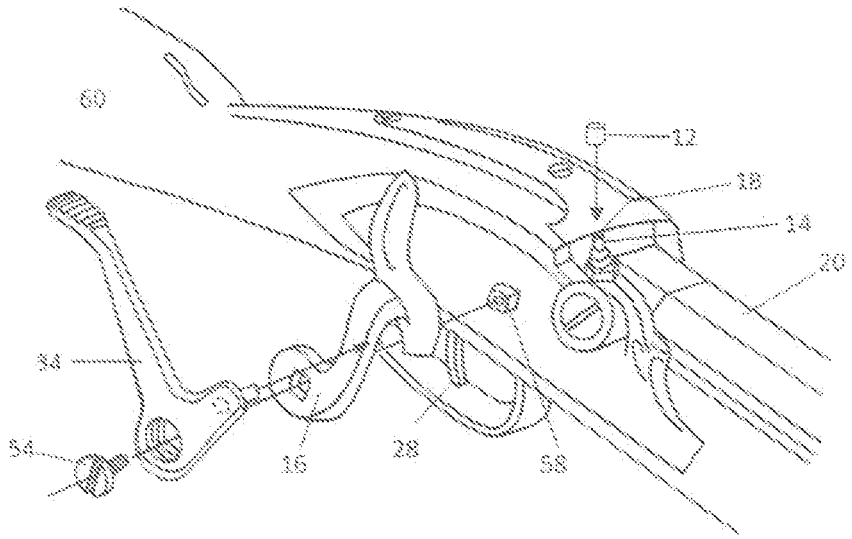
FIG. 2 shows how the invention is attached to a caplock muzzle loader and how it engages the hammer

FIG. 2 shows a caplock muzzle loader 60. The charge in a caplock is ignited by means of a primer cap 12 that is placed on a nipple 14. When the trigger 28 is pulled, it releases the hammer 16 which strikes the primer cap 12. The sparks from the primer cap 12 travel through the firing vent 18 into the firing chamber 20, igniting the charge that has been loaded through the muzzle as described above. FIG. 2 also shows how the invention 34 is mounted to the action pivot 58 directly over the hammer 16 by means of the firearm's original screw 54.

Figure 3:
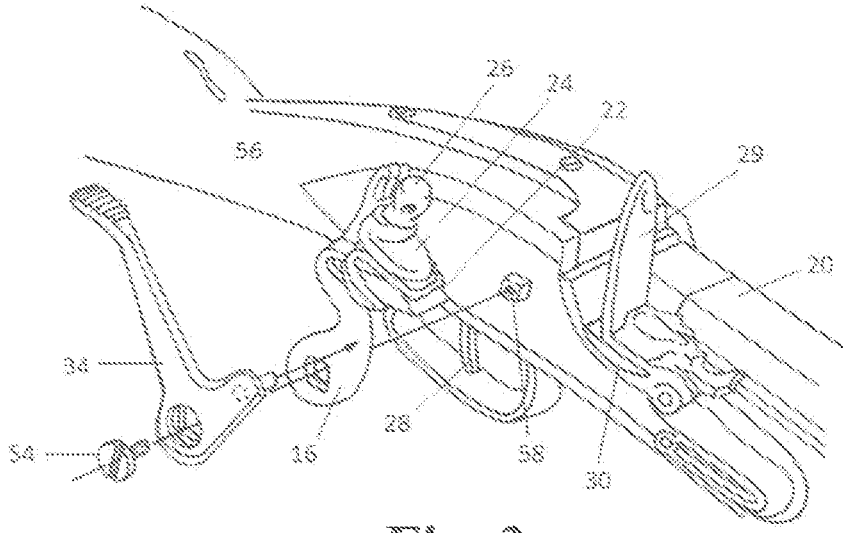
FIG. 3 shows how the invention is attached to a flintlock muzzle loader and how it engages the hammer

FIG. 3 shows a flintlock muzzle loader 56. The charge in a flintlock is ignited by means of a piece of flint 22 that is held in place by the jaws 24 of the hammer 16 by means of a jaw screw 26. When the trigger 28 is pulled, the hammer 16 is released and the flint 22 strikes a steel frizzen 29, creating spark. The spark then ignites a small amount of black powder that has been placed in the flash pan 30, which ignites the charge in the firing chamber 20 through the touch hole 32 (FIG. 4).

Figure 4:
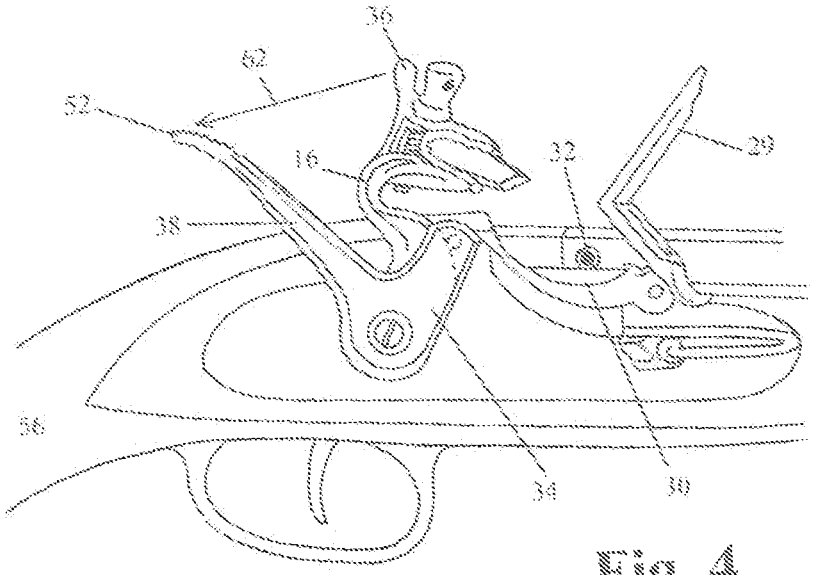
FIG. 4 illustrates the reduction in distance needed for the user's thumb to reach the hammer when it is in the half-cock or safety position.

FIG. 4 shows the reduction in distance 62 needed for the user to engage the hammer 16. To cock the firearm 56 without the hammer extension 34, the user would need to reach the hammer spur 36. With the invention 34, the thumb only needs to reach the knurled end 52 of the extension inn 38. To illustrate the ignition of the flintlock. FIG. 4 also shows the touch hole 32 and the frizzen 29 in forward position. This provides a means for the user to fill the flash pan 30 with a small amount of black powder.

Figure 5:
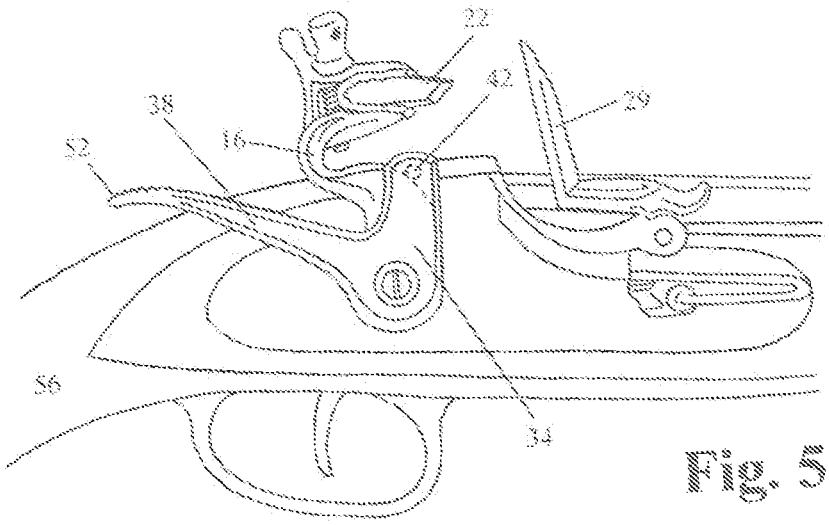
FIG. 5 illustrates the flintlock in the cocked position, when the firearm is ready to fire, and where the engaging pin engages with the hammer.

FIG. 5 shows the frizzen 29 in closed position which allows the flint 22 to produce spark when the hammer is released. FIG. 5 also provides a clearer understanding of how the engaging pin 42 engages the hammer 16 of the flintlock firearm 56. By pressing on the knurled end 52 of the extension arm 38, the force is transferred to the hammer 16 by means of the engaging pin 42, bringing the hammer 16 back to the cocked or engaged position.

Figure 6:
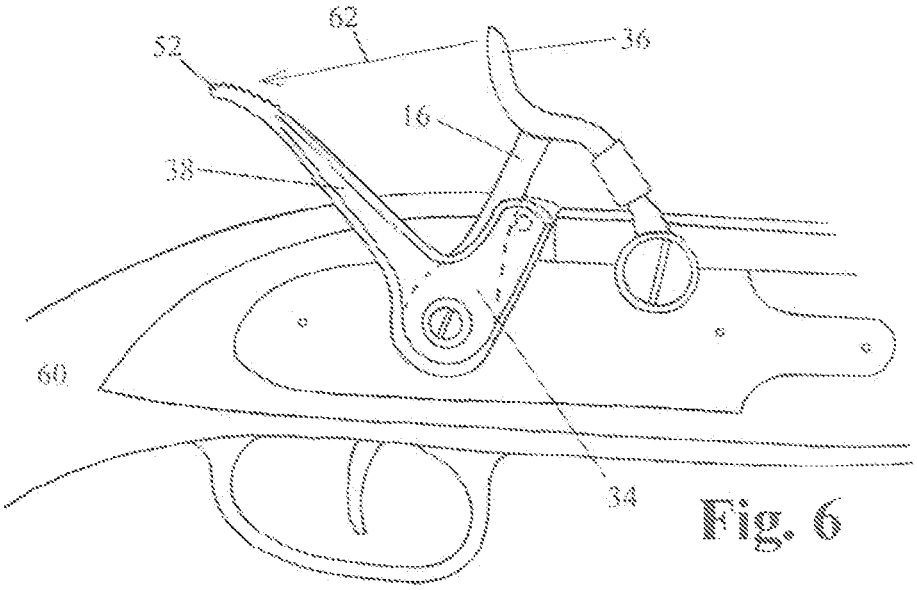
FIG. 6 illustrates the caplock in the fired position and the reduction in distance needed for the user's thumb to cock the hammer.

FIG. 6 illustrates that the caplock firearm 60 also has a hammer spur 36 that is far from the user's reach. The invention 34 provides the same reduction in distance 62 to engage the hammer 16 that is provided for the flintlock firearm 56. Again with the invention, the thumb only needs to reach the knurled end 52 of the extension arm 38 to operate the hammer 16.

Figure 7:
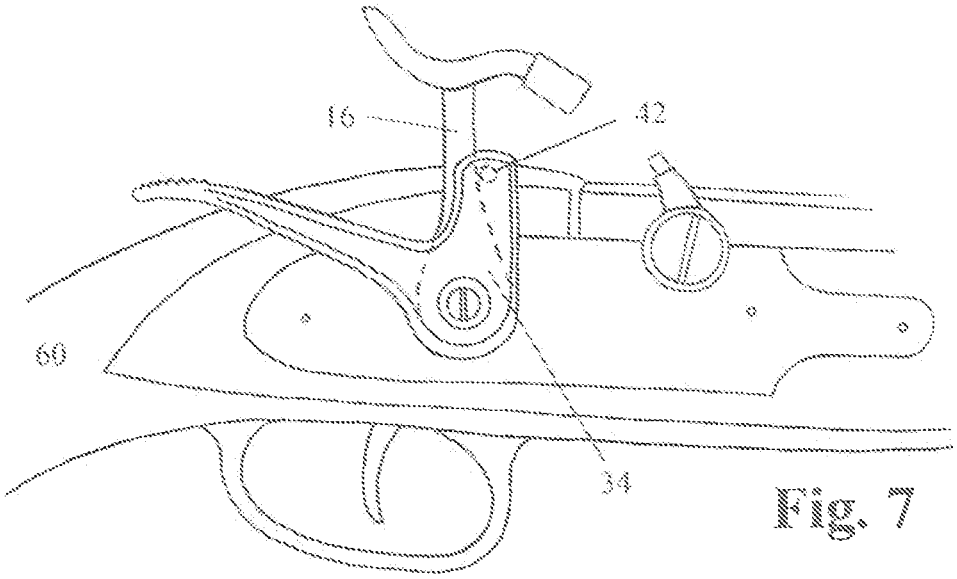
FIG. 7 illustrates the caplock in cocked position, and where the engaging pin engages the hammer.

FIG. 7 illustrates that the engaging pin 42 of the invention 34 engages with the hammer 16 of the caplock firearm 60 in the same manner it does with the flintlock firearm 56 in FIG. 5. This would be true for any other lock-type firearm as well.

The invention improves the ergonomics of the firearm by reducing the distance the user's thumb needs to engage the hammer, and by substantially reducing the force needed by the thumb to activate the hammer, as the extension arm provides more leverage. Furthermore, the unique design of the invention allows it to be used on any type of lock action firearm, making it a versatile accessory for the muzzle loading firearm user.

What is claimed is:

1. A muzzle-loading firearm comprising:

a stock;

a barrel fastened to said stock, said barrel having a chamber end and a muzzle end, wherein said chamber end has a touch hole or a nipple;

an action pivot affixed to said stock, wherein said action pivot may be rotated to an engaged position or a fired position;

a hammer affixed to said action pivot;

said hammer having a generally elongated body and a first and second end at respective ends of said body, and having a first central axis defused by an imaginary line extending along said body and aligned with both said first and said second ends, wherein said first end is secured to said action pivot and said second end contacts a frizzen or a primer cap when in said tired position;

a hammer extension having an L shape body with a central pivot point, a first and a second end at respective ends of said body, wherein said pivot point is secured with said hammer to said action pivot and said first end engages with said hammer and said second end provides leverage for rotating said action pivot between said fired position and said engaged position.

2. The muzzle-loading firearm recited in claim 1, wherein said hammer extension is positioned relative to said stock such that the user has an unobstructed view along the length of said barrel.

3. The muzzle-loading firearm recited in claim 1, wherein said action pivot is in said engaged position when said second end of the hammer extension is in a direction parallel to said barrel.

4. The muzzle-loading firearm recited in claim 1, wherein said action pivot is in said fired position when said second end of the hammer extension is in a direction perpendicular to said barrel.

5. The muzzle-loading firearm recited in claim 1, wherein said second end of the hammer, said action pivot, and said second end of the hammer extension form a V-shape.

6. The muzzle loading firearm recited in claim 5 wherein the angle of said V-shape is about 90°.

* * * * *